US009074438B2

(12) United States Patent
Caminari

(10) Patent No.: US 9,074,438 B2
(45) Date of Patent: Jul. 7, 2015

(54) HYDROSTATIC PRESSURE INDEPENDENT ACTUATORS AND METHODS

(71) Applicant: Schlumberger Technology Corporation, Sugar Land, TX (US)

(72) Inventor: Richard T. Caminari, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 128 days.

(21) Appl. No.: 13/668,688

(22) Filed: Nov. 5, 2012

(65) Prior Publication Data

US 2013/0118758 A1 May 16, 2013

Related U.S. Application Data

(60) Provisional application No. 61/560,065, filed on Nov. 15, 2011.

(51) Int. Cl.

| | |
|---|---|
| ***E21B 23/04*** | (2006.01) |
| ***E21B 23/00*** | (2006.01) |
| ***F17D 1/16*** | (2006.01) |
| ***E21B 34/10*** | (2006.01) |

(52) U.S. Cl.

CPC ..... *E21B 23/006* (2013.01); *F17D 1/16* (2013.01); *E21B 23/04* (2013.01); *E21B 34/10* (2013.01)

(58) Field of Classification Search

CPC ..... E21B 34/10; E21B 34/06; E21B 23/04; E21B 23/006; F17D 1/16

USPC ..... 166/373, 319, 325, 332.1, 316; 137/115.13

See application file for complete search history.

(56) References Cited

U.S. PATENT DOCUMENTS 5,810,087 A * 9/1998 Patel ..... 166/373

FOREIGN PATENT DOCUMENTS

| | | |
|---|---|---|
| CA | 2572923 | 2/2006 |
| GB | 2385345 | 8/2003 |
| WO | 0029715 | 5/2000 |
| WO | 2004011812 | 2/2004 |

* cited by examiner

*Primary Examiner* — Yong-Suk (Philip) Ro

(74) *Attorney, Agent, or Firm* — David J. Groesbeck; Brandon S. Clark

(57) ABSTRACT

An actuator that may be used in a wellbore to change the state of a downhole tool. The actuator has an operator that is axially movable in response to changes in tubing pressure. The actuator includes a hydraulic circuit that creates a temporary reference pressure against which the tubing pressure indexes the operator.

20 Claims, 6 Drawing Sheets

HYDROSTATIC PRESSURE INDEPENDENT ACTUATORS AND METHODS

BACKGROUND

This section provides background information to facilitate a better understanding of the various aspects of the disclosure. It should be understood that the statements in this section of this document are to be read in this light, and not as admissions of prior art.

Hydrocarbon fluids such as oil and natural gas are obtained from a subterranean geological formation, referred to as a reservoir, by drilling a well that penetrates the hydrocarbon-bearing formation. Forms of well completion components may be installed in the wellbore in order to control and enhance efficiency of producing fluids from the reservoir. Some of the equipment utilized in the drilling, completion, and or production of the well is actuated from one position to another.

SUMMARY

In accordance with one or more embodiments, a hydrostatic pressure independent actuator includes an operator axially movable in response to a pressure differential between a first chamber and a second chamber. A hydraulic circuit couples the first chamber and the second chamber to an axial bore of the actuator. The second chamber is hydraulically coupled to the axial bore through a control device to create a temporary pressure differential between the first chamber and the second chamber when manipulating the axial bore pressure. For example, the hydraulic circuit may maintain a pressure in the second chamber less than the axial pressure when increasing the axial bore pressure. In some embodiments, for example, the hydraulic circuit may maintain a pressure in the second chamber greater than the axial bore pressure when the axial bore pressure is being decreased.

In accordance to one or more embodiments, a method includes manipulating tubing pressure in a tubular string disposing an actuator in a wellbore, creating a temporary pressure differential between a first chamber and a second chamber of the actuator when manipulating the pressure, and axially moving an operator in response to the temporary pressure differential.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

Embodiments of hydrostatic pressure independent actuators and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
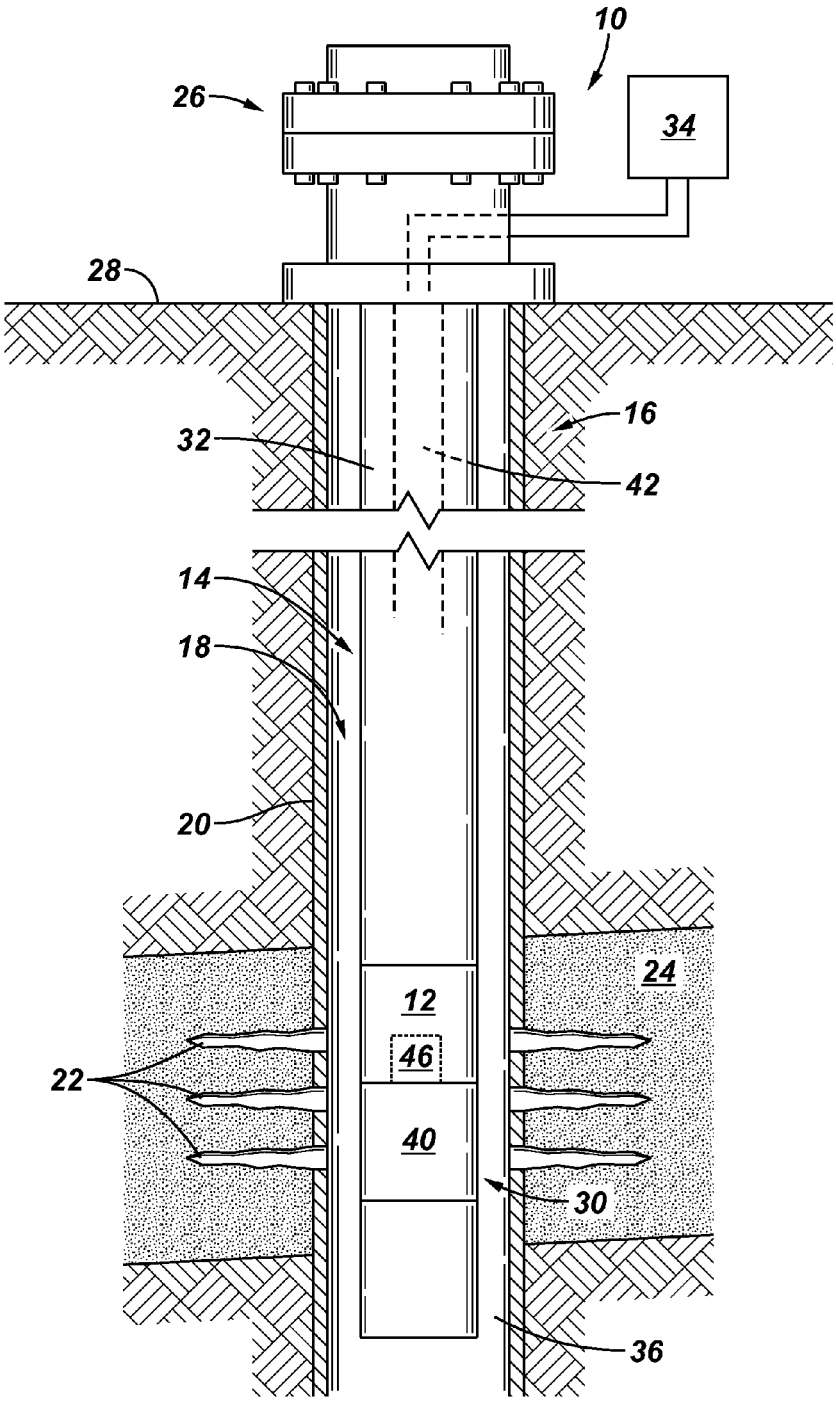
FIG. 1 illustrates a well system in which embodiments of hydrostatic pressure independent actuators and methods can be utilized.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface. In this disclosure, "hydraulically coupled," "hydraulically connected," and similar terms, may be used to describe bodies that are connected in such a way that fluid pressure may be transmitted between and among the connected items.

FIG. 1 illustrates an example of a well system 10 in which embodiments of hydrostatic pressure independent actuators and methods, generally denoted by the numeral 12, may be utilized. The illustrated well system 10 comprises a well completion 14 deployed for use in a well 16 having a wellbore 18. Wellbore 18 may be lined with casing 20 for example having openings 22 (e.g., perforations, slotted liner, screens) through which fluid is able to flow between the surrounding formation 24 and wellbore 18. Completion 14 is deployed in wellbore 18 below a wellhead 26 disposed at a surface 28 (e.g., terrestrial surface, seabed).

Actuator 12 is operationally connected with a tool element 40 to form a downhole tool 30. In this embodiment downhole tool 30 is deployed in wellbore 18 on a tubular string 32. Tubular string 32, also referred to as tubing 32, may be formed by interconnected sections of threaded pipe, continuous lengths of pipe (e.g., coiled tubing, flexitubo), and the like providing an axial bore 42. Although downhole tool 30 is depicted as being disposed in a vertical portion of wellbore 18, downhole tool 30 may be disposed in a lateral or deviated section. An annulus 36 is located between an exterior surface of tubing 32 and downhole tool 30 and the interior surface of wellbore 18. The pressure in annulus 36 may be referred to in some embodiments as casing pressure and it is associated with the hydrostatic pressure of the column of fluid in annulus 36.

In a non-limiting example, downhole tool 30 is described as a valve, for example a formation isolation valve, and tool element 40 may be a ball-type valve control element or a flapper-type valve control element. Other types of tool elements, for example sleeves, are contemplated and considered within the scope of the appended claims. Downhole tool 30 is a device having two or more operating positions (i.e., states), for example, open and closed positions for controlling fluid flow, partially opened (e.g., choked) fluid control positions, and on and off positions. Examples of downhole tool 30 include without limitation, valves such as formation isolation valves ("FIV"), inflow-outflow control devices ("ICD"), flow control valves ("FCV"), chokes and the like, as well other downhole devices.

Actuator 12 operates tool element 40 for controlling the state, for example open or closed, of tool element 40. Actuator 12 is an interventionless apparatus, also known as a trip saving device, facilitating remote actuation of tool element 40, for example from surface 28. In this regard, in accordance to some embodiments, actuator 12 of downhole tool 30 may be remotely operated by manipulating the pressure, herein called the "tubing pressure," inside of tubular string 32. The tubing pressure may be manipulated for example by operation of pump 34 to increase and decrease the tubing pressure. Actuator 12 may include a counter mechanism 46 (e.g., indexer, J-slot) that prevents actuator 12 from changing the position of tool element 40 until a pre-determined number or sequence of pressure cycles are applied. A pressure cycle may be completed by increasing the tubing pressure and the subsequent bleed-down of the tubing pressure. According to some embodiments, actuator 12 is operated by the changes in the tubing pressure and the actuator operation is not dependent on a separate reference pressure such as casing pressure or a chamber of highly pressurized gas, such as nitrogen.

Figure 2:
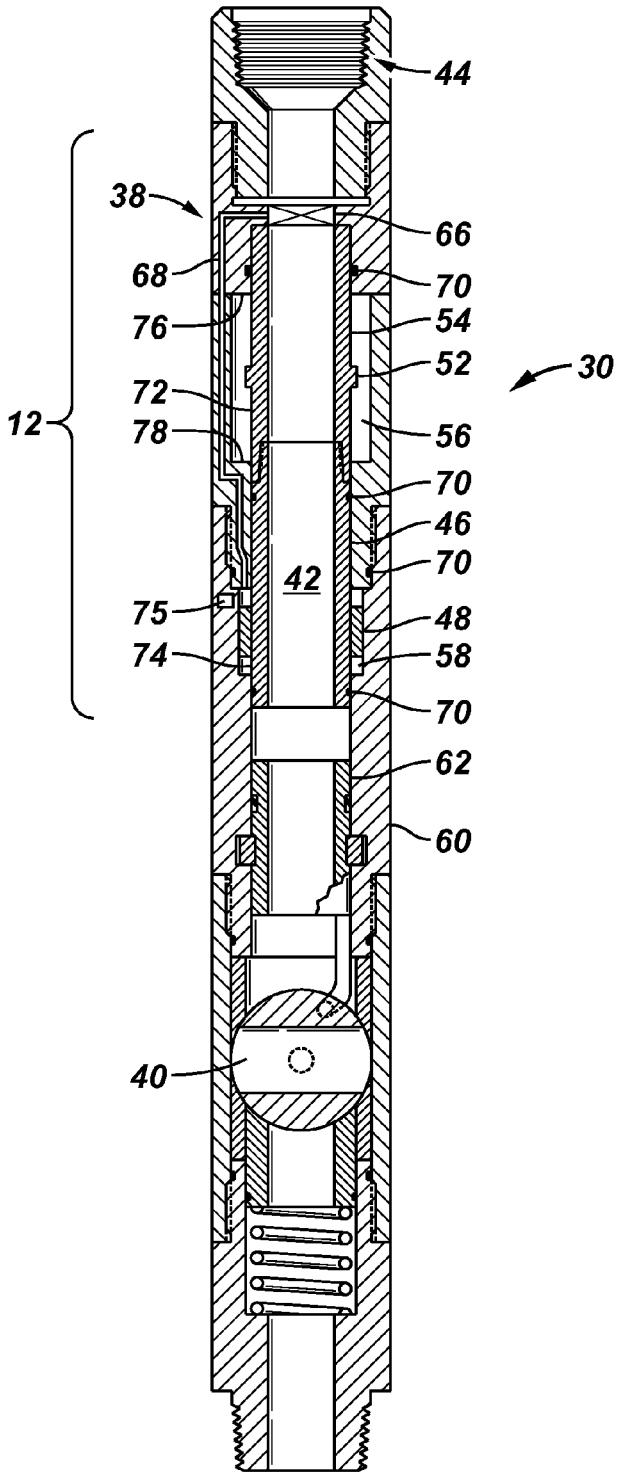
FIG. 2 illustrates an example of a downhole tool incorporating a hydrostatic pressure independent actuator in accordance with one or more embodiments.

FIG. 2 illustrates an example of a downhole tool 30 depicted as a formation isolation valve ("FIV") incorporating an actuator 12 in accordance to one or more embodiments. In the depicted embodiment, tool member 40 is a ball-type valve closure member. Tool member 40 is illustrated in a closed position blocking fluid flow through axial bore 42. Referring to FIGS. 1 and 2, the depicted downhole tool 30 includes threaded ends 44 for connecting to tubing 32 and forming axial bore 42 through tubing 32 and downhole tool 30.

Figure 3:
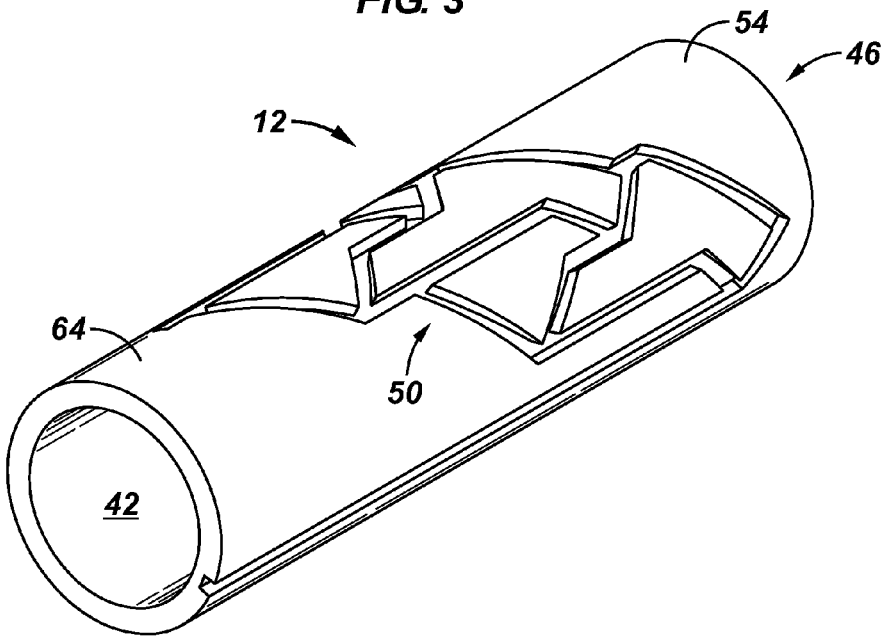
FIG. 3 illustrates an example of a counter mechanism that may be utilized with hydrostatic pressure independent actuators and methods in accordance with one or more embodiments.

Depicted actuator 12 includes a tool operator or operator mandrel 54 (e.g., piston), a first chamber 56, and a second chamber 58. In the depicted embodiment, operator mandrel 54 is operationally connected to housing 60 by a counter mechanism 46. With reference to FIG. 3, an embodiment of counter mechanism 46 includes a J-slot pattern 50 formed for example on an outer surface 64 of a portion of operator mandrel 54. The depicted counter mechanism 46 is a non-limiting example of a counter mechanism that may be utilized in various embodiments and which may be configured different variations and include various devices.

Axial movement of operator mandrel 54 may be held between a first stop 76 and a second stop 78 by the connection of operator mandrel 54 with housing 60 by counter mechanism 46. For example, in the depicted embodiment, upward axial movement of operator mandrel 54 may be stopped by the contact of lug 52 of operator mandrel 54 against first stop 76 which is depicted as a shoulder of housing 60. Downward movement of operator mandrel 54 may be limited by counter mechanism 46 to a position above second stop 78 until the sequence of tubing pressure cycles defined by the J-slot pattern 50 of counter mechanism 46 is completed. Upon completion of the cycle count of counter mechanism 46, operator mandrel 54 is permitted to move axially further than previously permitted to engage latch member 62 to move tool member 40 to the next position, for example to the open position in this embodiment. In the actuation stroke, or cycle, of operator mandrel 54, lug 52 may be moved proximate to or in contact with the second stop 78. Operator mandrel 54 is described as axially movable between a first position and a second position. For purposes of description, the first position is described with reference to first stop 76 and the second position is described with reference to second stop 78, however, it is noted that the first and second positions are not used to identify exact locations but used to generally identify positions that are axially spaced apart from one another.

Chambers 56, 58 may be provided in the wall of housing 60. For example, in the depicted embodiment each chamber 56, 58 is formed between a portion of operator mandrel 54 and housing 60 between seals 70, for example O-rings. Operator mandrel 54 includes a first side 72 open to first chamber 56 and a second side 74 open to second chamber 58. First and second chambers 56, 58 are each hydraulically coupled with axial bore 42 for example through pressure compensator 66 (i.e., tubing compensator) and conduit 68 as further described below with reference to the illustrated hydraulic circuits 38. In accordance with some embodiments of the hydrostatic pressure independent actuators and methods, the hydraulic circuit may be a closed loop system containing a clean operating fluid (e.g., oil, water, gas, compressible liquids). According to one or more embodiments, second chamber 58 is hydraulically coupled with axial bore 42 through one or more control devices, generally denoted by the numeral 75. Control devices 75 may include without limitation, relief devices 80 (FIGS. 4, 8), check valve 82 (FIGS. 4, 8), flow restrictors 84 (FIG. 6), and the like. Control device 75 may be hydraulically coupled between axial bore 42 and second chamber 58 to create a reference pressure in second chamber 58 in response to manipulating the tubing pressure, for example increasing tubing pressure and or reducing tubing pressure. The volume of second chamber 58 and the volume of the operating fluid is sufficient to permit a pressure differential across mandrel 54 and to allow mandrel 54 to stroke. Accordingly, in some embodiments operating fluid may be a compressible fluid (i.e., liquid, gas).

Operator mandrel 54 may be urged to a first position in response to a resilient biasing member 48 (e.g., mechanical spring) acting on operator mandrel 54 in a first direction. In the embodiment depicted in FIG. 2, mechanical spring 48 is in second chamber 58. The first position is associated with a position proximate to first stop 76 relative to the second position which is located toward second stop 78. According to one or more embodiments, in response to manipulating the tubing pressure actuator hydraulic circuit 38 creates a temporary reference pressure, for example in second chamber 58, against which operator mandrel 54 is cycled to allow counter mechanism 46 to count cycles and to release operator mandrel 54 to engage and operate tool member 40 to the next position.

Figure 4:
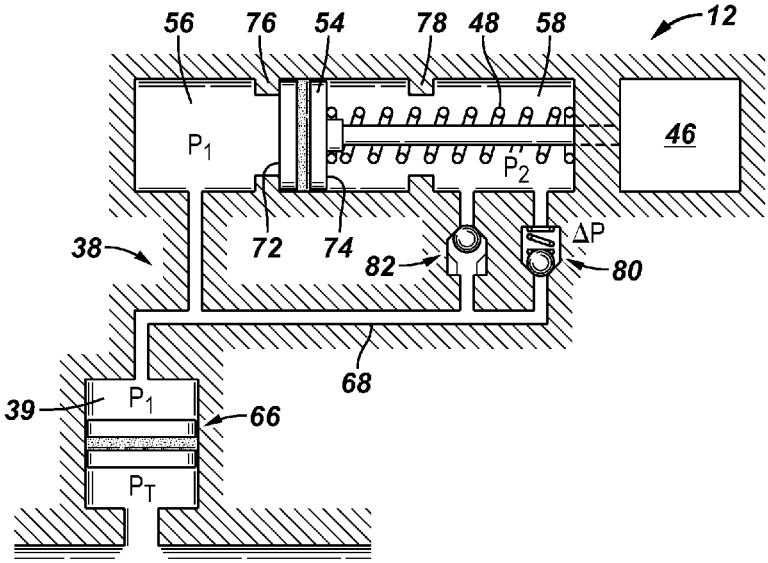
FIG. 4 is a schematic diagram of an embodiment of a hydraulic circuit in accordance to one or more hydrostatic pressure independent actuator embodiments.
Figure 5:
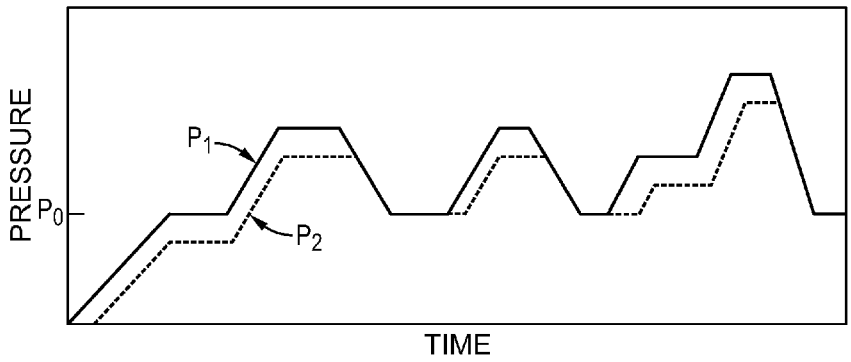
FIG. 5 is a graphical illustration of a pressure versus time response of the embodiment illustrated in FIG. 4.

FIG. 4 is a schematic diagram of an embodiment of a hydraulic circuit 38 in accordance with one or more embodiments of the hydrostatic pressure independent actuator 12. FIG. 5 illustrates a graphical representation of a pressure versus time response of the embodiment illustrated in FIG. 4.

With reference also to FIGS. 1 and 2, operator mandrel 54 is illustrated as a piston, axially movable between a first position represented by first stop 76 and a second position represented by second stop 78. Operator mandrel 54 is operationally connected with a counter mechanism 46. First side 72 of operator mandrel 54 is open to first chamber 56 and second side 74 of operator mandrel 54 is open to second chamber 58. Hydraulic circuit 38 is depicted as a closed loop system filled with an operating fluid 39. According to some embodiments operating fluid 39 may be a compressible fluid (i.e., gas, liquid). Axial bore 40 of tubing 32 is hydraulically coupled with first chamber 56 and second chamber 58 through pressure compensator 66 (i.e., tubing compensator) and conduit 68. Second chamber 58 is hydraulically coupled with axial bore 42 (i.e., tubing pressure PT) through one or more control devices, generally denoted by the numeral 75 in FIG. 2 and specifically illustrated as a pressure relief valve 80 (e.g., poppet valve) and a check valve 82 (i.e., one-way valve) in FIG. 4, to create a temporary reference pressure against which to axially cycle operator mandrel 54. In the embodiment depicted in FIG. 4, first side 72 and second side 74 of operator mandrel 54 have substantially the same surface area open to the respective first and second chambers 56, 58 and therefore operator mandrel 54 is a balanced piston.

An example of a method of operating an actuator 12 and a downhole tool 30 is now described with reference to FIGS. 1-5. In the depicted embodiment, check valve 82 permits operating fluid 39 to flow out of second chamber 58 and relief valve 80 (i.e., poppet valve) maintains pressure P2 in second chamber 58 at a value less than pressure P1. For example, when downhole tool 30 is resident in wellbore 18 for a period of time, the tubing pressure PT and pressure P1 in first chamber 56 equalize and biasing member 48 in the depicted embodiment locates operator mandrel 54 in a first position. Operator mandrel 54 is illustrated in a first position in FIG. 4. When the tubing pressure PT is increased, first pressure P1 increases and pressure relief valve 80 maintains a differential pressure between first chamber 56 (i.e., pressure P1) and second chamber 58 (i.e., pressure P2) that permits operator mandrel 54 to move in the second direction toward second stop 78. The differential pressure created during the tubing pressure rise is in response to the temporary reference pressure created in second chamber 58 during the pressure increase half of a tubing pressure cycle (i.e., cycle count). For example, as tubing pressure PT and first pressure P1 increase, hydraulic circuit 38 maintains a lower pressure P2 in second chamber 58 than tubing pressure PT by not allowing operating fluid 39 to enter second chamber 58 via relief valve 80. The volume of second chamber 58 and/or the compressibility of operating fluid 39 allow for a differential pressure. Upon bleed down of tubing pressure PT, check valve 82 allows the pressure to equalize across operator mandrel 54 (i.e., P1=P2) and the force of resilient biasing member 48 urges operator mandrel 54 in the first direction toward first stop 76. Accordingly, manipulation of the tubing pressure PT cycles operator mandrel 54 up and down by creating a temporary reference pressure in second chamber 58 thereby removing the dependence on a separate reference pressure such as a high pressure gas charge or the hydrostatic annulus 36 pressure.

Figure 6:
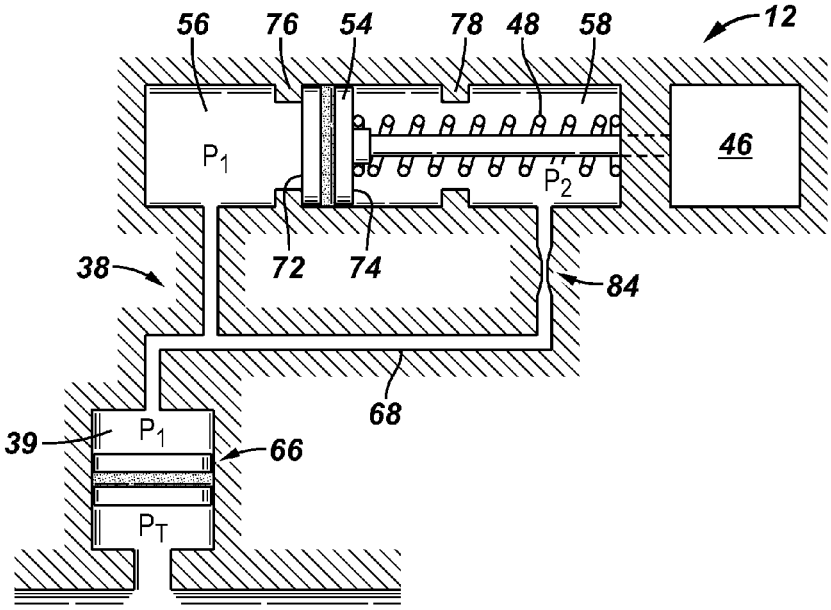
FIG. 6 is a schematic diagram of an embodiment of a hydraulic circuit in accordance to one or more hydrostatic pressure independent actuator embodiments.
Figure 7:
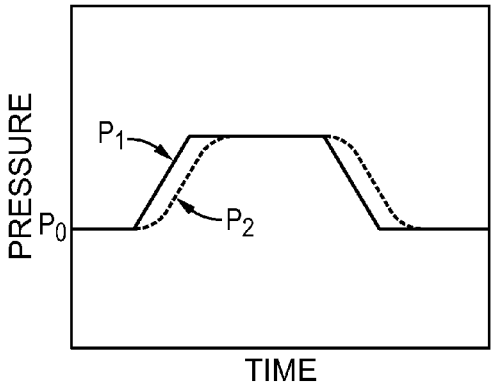
FIG. 7 is a graphical illustration of a pressure versus time response of the embodiment illustrated in FIG. 6.

FIG. 6 is a schematic diagram of an embodiment of a hydraulic circuit 38 in accordance with one or more embodiments of the hydrostatic pressure independent actuator 12. FIG. 7 illustrates a graphical representation of a pressure versus time response of the embodiment illustrated in FIG. 6.

With reference also to FIGS. 1 and 2, operator mandrel 54 is illustrated as a piston, axially movable between a first position represented by first stop 76 and a second position represented by second stop 78. Operator mandrel 54 is operationally connected with a counter mechanism 46. First side 72 of operator mandrel 54 is open to first chamber 56 and second side 74 of operator mandrel 54 is open to second chamber 58. Hydraulic circuit 38 is depicted as a closed loop system containing operating fluid 39. Axial bore 40 of tubing 32 is hydraulically coupled with first chamber 56 and second chamber 58 through pressure compensator 66 (i.e., tubing compensator) and conduit 68. Second chamber 58 is hydraulically coupled with axial bore 42 (i.e., tubing pressure PT) through one or more control devices, generally denoted by the numeral 75 in FIG. 2 and specifically illustrated as a flow restrictor 84 (e.g., orifice) in FIG. 6, to create a temporary reference pressure against which to axially cycle operator mandrel 54. In the embodiment depicted in FIG. 6, first side 72 and second side 74 of operator mandrel 54 have substantially the same surface area open to the respective first and second chambers 56, 58 and therefore operator mandrel 54 is a balanced piston.

An example of a method of operating an actuator 12 and a downhole tool 30 is now described with reference to FIGS. 1-3 and 6-7. Upon residence of downhole tool 30 in wellbore 18 for a period of time, the tubing pressure PT and the pressure P1 in first chamber 56 and second pressure P2 in second chamber 58 equalize, PT=P1=P2. When the pressure is equalized, biasing member 48 in the depicted embodiment locates operator mandrel 54 in a first position. Operator mandrel 54 is illustrated in the first position in FIG. 6. When the tubing pressure PT is increased, the first pressure P1 increases and flow restrictor 84 restricts the rate at which operating fluid 39 fills second chamber 58 thereby creating a temporary reference pressure in second chamber 58 that is less than the pressure P1 in first chamber 56 and less than tubing pressure PT. The temporary reference pressure is dependent on the pressure rate of change between first chamber 56 and second chamber 58. Operator mandrel 54 moves in the second direction in response to the temporary pressure differential that is created during the tubing pressure PT increase. As operating fluid 39 continues to flow through flow restrictor 84, the pressure equalizes in first chamber 56 and second chamber 58, PT=P1=P2, with operator mandrel 54 in the second position. In accordance to embodiments utilizing a resilient biasing member 48, operator mandrel 54 may be urged in the first direction and back to the first position by the biasing member 48.

Upon reducing tubing pressure PT, operating fluid 39 flows more quickly out of first chamber 56 than it flows through flow restrictor 84 and out of second chamber 58 thereby creating a temporary reference pressure in second chamber 58 that is greater than the first pressure P1 in first chamber 56 and greater than the tubing pressure PT. Operator mandrel 54 moves in the second direction in response to the temporary pressure differential created during the tubing pressure PT bleed-down. Accordingly, manipulation of the tubing pressure indexes operator mandrel 54 up and down by creating a temporary reference pressure in second chamber 58 thereby removing the dependence on a separate reference pressure such as a high pressure gas charge or the hydrostatic annulus 36 pressure.

Figure 8:
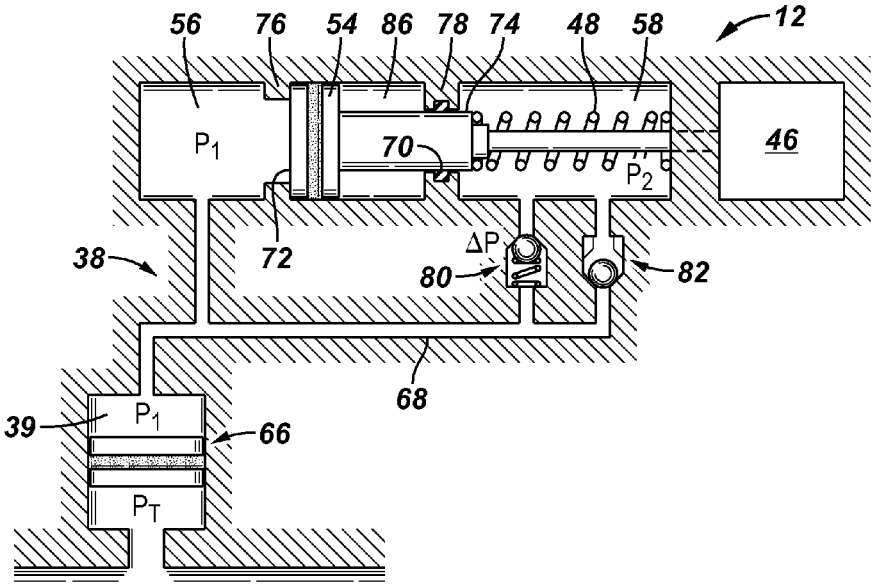
FIG. 8 is a schematic diagram of an embodiment of a hydraulic circuit in accordance to one or more hydrostatic pressure independent actuator embodiments.
Figure 9:
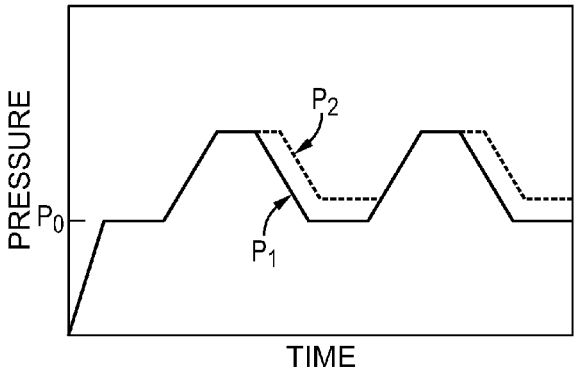
FIG. 9 is a graphical illustration of a pressure versus time response of the embodiment illustrated in FIG. 8.

FIG. 8 is a schematic diagram of an embodiment of a hydraulic circuit 38 in accordance with one or more embodiments of the hydrostatic pressure independent actuator 12. FIG. 9 illustrates a graphical representation of a pressure versus time response of the embodiment illustrated in FIG. 8.

With reference also to FIGS. 1 and 2, operator mandrel 54 is illustrated as a piston, axially movable between a first position represented by first stop 76 and a second position represented by second stop 78. Operator mandrel 54 is operationally connected with a counter mechanism 46. First side 72 of operator mandrel 54 is open to first chamber 56 and second side 74 of operator mandrel 54 is open to second chamber 58. Hydraulic circuit 38 is depicted as a closed loop system containing operating fluid 39. Axial bore 40 of tubing 32 is hydraulically coupled with first chamber 56 and second chamber 58 through pressure compensator 66 (i.e., tubing compensator) and conduit 68. Second chamber 58 is hydraulically coupled with axial bore 42 (i.e., tubing pressure PT) through one or more control devices, generally denoted by the numeral 75 in FIG. 2 and specifically illustrated as a pressure relief valve 80 and a check valve 82 (i.e., one-way valve) in FIG. 8, to create a temporary reference pressure against which to cycle operator mandrel 54.

In the embodiment depicted in FIG. 8, an atmospheric chamber 86 is sealed between first and second chambers 56, 58. First side 72 has a larger surface area than second side 74 and operator mandrel 54 may be referred to as an unbalanced piston. Resilient biasing member 48 provides an additional force to second side 72 to urge operator mandrel 54 in the first direction. Operator mandrel 54 is illustrated in FIG. 8 in the first position. According to embodiments, first and second sides 72, 74 are sized such that when the pressure P1 in first chamber 56 and the pressure P2 in second chamber are equal, operator mandrel 54 is urged in the second direction and held in the second position, for example the down position. Check valve 82 allows pressure to equalize in chambers 56, 58 during tubing pressure PT increase portion of the pressure cycle. Accordingly, in a static position, for example when downhole tool 30 is resident in the wellbore for a period of time, the pressure in first chamber 56 and second chamber 58 equalize with the tubing pressure PT, i.e., PT=P1=P2. In the static position, unbalanced operator mandrel 54 is biased toward the second position located toward second stop 78. Operator mandrel 54 is illustrated in FIG. 8 in the first position.

An example of a method of operating an embodiment of actuator 12 and a downhole tool 30 is now described with reference to FIGS. 1-3 and 8-9. Upon residence in wellbore 18, pressure P1 in first chamber 56 and pressure P2 in second chamber 58 equalize with tubing pressure PT and operator mandrel 54 is moved toward the second position in response to the surface area of first side 72 being greater than the surface area of second side 74. To cycle operator mandrel 54 and the coupled counter mechanism 46, tubing pressure PT is manipulated by bleeding down tubing pressure PT and creating a temporary pressure differential between first chamber 56 and second chamber 58. As tubing pressure PT is reduced, relief valve 80 maintains a back pressure in second chamber 58 creating a temporary reference pressure in second chamber 58 that is greater than first pressure P1 and tubing pressure PT. Operator mandrel 54 moves in the first direction in response to the created temporary pressure differential. In this embodiment, a temporary reference pressure is created in second chamber 58 during tubing pressure PT bleed-down to cycle operator mandrel 54 in the first direction. As tubing pressure PT is increased again, the pressure will equalize in first and second chambers 56, 58 and operator mandrel 54 will move again in the second direction toward second stop 78.

The foregoing outlines features of several embodiments of hydrostatic pressure independent actuators and methods so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An actuator, comprising:

an operator disposed in an actuator employed in a well system, the operator including an axial bore, a first side in communication with a first chamber within the actuator, a second side in communication with a second chamber within the actuator, and a seal to maintain isolation of the first chamber with respect to the second chamber across the operator, the operator axially movable in response to a pressure differential between the first chamber and the second chamber;

a hydraulic circuit hydraulically coupling the first chamber and the second chamber to the axial bore;

a control device hydraulically coupled between the axial bore and the second chamber, whereby the control device creates a temporary pressure differential between the first chamber and the second chamber when manipulating a pressure in the axial bore, wherein manipulating the axial bore pressure is one of increasing the axial bore pressure and decreasing the axial bore pressure; and a biasing member acting against the operator to bias the operator in a desired direction.

2. The actuator of claim 1, wherein the control device maintains a pressure in the second chamber less than the axial bore pressure when increasing the axial bore pressure.

3. The actuator of claim 1, wherein:

the control device comprises one selected from a flow restrictor and a pressure relief device; and the control device maintains a pressure in the second chamber less than the axial bore pressure when increasing the axial bore pressure.

4. The actuator of claim 1, wherein the control device maintains a pressure in the second chamber greater than the axial bore pressure when decreasing the axial bore pressure.

5. The actuator of claim 1, wherein:

the control device comprises one selected from a flow restrictor and a pressure relief device; and the control device maintains a pressure in the second chamber greater than the axial bore pressure when decreasing the axial bore pressure.

6. The actuator of claim 1, wherein:

the control device maintains a pressure in the second chamber less than the axial bore pressure when increasing the axial bore pressure to move the operator in a first direction; and the control device maintains a pressure in the second chamber greater than the axial bore pressure when decreasing the axial bore pressure to move the operator in a second direction.

7. The actuator of claim 1, comprising:

the first side of the operator and the second side of the operator having substantially equal surface areas; and the control device maintains a pressure in the second chamber less than the axial bore pressure when increasing the axial bore pressure to move the operator in a second direction.

8. The actuator of claim 7, wherein the control device comprises one selected from a flow restrictor and a pressure relief device.

9. A well system, comprising:

a tubing having an axial bore disposed in a wellbore;

a downhole tool operable from a first state to a second state deployed in the wellbore on the tubing;

an actuator coupled to the downhole tool to change the state of the downhole tool, the actuator operated by manipulating tubing pressure in the axial bore, the actuator comprising:

an operator including a first side exposed to a first chamber and a second side exposed to a second chamber, the operator providing a sealed barrier between the first chamber and the second chamber while being axially movable in response to a pressure differential between the first chamber and the second chamber;

a hydraulic circuit hydraulically coupling the first chamber and the second chamber to the axial bore; and a control device hydraulically coupled between the axial bore and the second chamber via a conduit routed externally of the operator, whereby the control device creates a temporary pressure differential between the first chamber and the second chamber in response to the manipulating the tubing pressure.

10. The well system of claim 9, wherein:

the control device maintains a pressure in the second chamber less than the tubing pressure when increasing the tubing pressure; and the control device maintains a pressure in the second chamber greater than the tubing pressure when decreasing the tubing pressure.

11. The well system of claim 9, comprising:

a biasing member urging the operator in a first direction;

the first side of the operator having a larger surface area than the second side of the operator to move the operator to a second position in response to an equal pressure in the first chamber and the second chamber; and the control device maintains a pressure in the second chamber greater than the tubing pressure to move the operator in the second direction when decreasing the tubing pressure.

12. The well system of claim 9, comprising:

a biasing member urging the operator in a first direction;

the first side of the operator and the second side of the operator having substantially equal surface areas; and the control device maintains a pressure in the second chamber less than the tubing pressure to move the operator in a second direction when increasing the tubing pressure.

13. An actuating method, comprising:

manipulating a tubing pressure in an axial bore of a tubular string disposed in a wellbore comprising an actuator having an operator having a first side open to a first chamber and a second side open to a second chamber, the first chamber and the second chamber hydraulically coupled with the axial bore;

biasing the operator in a desired direction with a biasing mechanism;

creating a temporary pressure differential between the first chamber and the second chamber when manipulating the tubing pressure by applying the temporary pressure differential via flow paths external to the operator; and axially moving the operator in response to the temporary pressure differential.

14. The method of claim 13, wherein the second chamber is hydraulically coupled to the axial bore through a control device.

15. The method of claim 13, wherein creating a temporary pressure differential comprises maintaining a pressure in the second chamber less than the tubing pressure when increasing the tubing pressure.

16. The method of claim 13, wherein creating a temporary pressure differential comprises maintaining a pressure in the second chamber greater than the tubing pressure when increasing the tubing pressure.

17. The method of claim 13, comprising:

axially moving the operator in a first direction in response to maintaining a pressure in the second chamber less than the tubing pressure when increasing the tubing pressure; and axially moving the operator in a second direction in response to maintaining a pressure in the second chamber greater than the tubing pressure when decreasing the tubing pressure.

18. The method of claim 13, comprising:

moving the operator to a second position in response to pressure in the first chamber and pressure in the second chamber being equal; and axially moving the operator in the first direction from the second position in response to maintaining a pressure in the second chamber greater than the tubing pressure when decreasing the tubing pressure.

19. The method of claim 13, comprising:

axially moving the operator in a second direction in response to maintaining a pressure in the second chamber less than the tubing pressure when increasing the tubing pressure.

20. The method of claim 13, comprising:

axially moving the operator in a second direction in response to maintaining a pressure in the second chamber less than the tubing pressure when increasing the tubing pressure; and wherein second chamber is hydraulically coupled to the axial bore through a control device selected from one of a flow restrictor and a pressure relief device.

* * * * *